US005857920A

United States Patent [19]

Hong

[11] Patent Number: 5,857,920

[45] Date of Patent: Jan. 12, 1999

[54] GOLF CLUB

[76] Inventor: Joseph Hong, 17214 Redmond Way, Redmond, Wash. 98052

[21] Appl. No.: 852,009

[22] Filed: May 6, 1997

[51] Int. Cl.[6] ..... A63B 53/04; A63B 69/36

[52] U.S. Cl. ..... 473/240; 473/241; 473/325

[58] Field of Search ..... 473/325, 330, 473/240, 241

[56] References Cited

U.S. PATENT DOCUMENTS

| | | | |
|---|---|---|---|
| 1,537,711 | 5/1925 | Spafford | 473/325 |
| 1,674,173 | 6/1928 | Haupt | 473/330 |
| 3,392,977 | 7/1968 | De Lacey | 273/80.1 |
| 3,397,888 | 8/1968 | Springer et al. | 273/80.1 |
| 3,403,912 | 10/1968 | Maroun | 473/240 |
| 4,114,886 | 9/1978 | Koch | 473/325 X |
| 4,846,477 | 7/1989 | Phelan | 473/330 |
| 5,320,346 | 6/1994 | Phillips | 273/79 |
| 5,333,873 | 8/1994 | Burke | 473/330 X |
| 5,348,295 | 9/1994 | Phillips | 273/79 |
| 5,407,196 | 4/1995 | Busnardo | 273/78 |
| 5,458,335 | 10/1995 | Hattori | 273/168 |
| 5,462,279 | 10/1995 | Culpepper | 273/164.1 |
| 5,470,063 | 11/1995 | Fisher | 273/80.1 |
| 5,480,145 | 1/1996 | Sherwood | 273/77 A |
| 5,482,282 | 1/1996 | Willis | 273/186.2 |
| 5,482,283 | 1/1996 | Wall | 273/186.3 |
| 5,505,453 | 4/1996 | Mack | 273/186.2 |
| 5,509,660 | 4/1996 | Elmer | 473/288 |
| 5,518,241 | 5/1996 | McHale | 473/349 |
| 5,531,445 | 7/1996 | Levocz et al. | 473/341 |
| 5,538,245 | 7/1996 | Moore | 473/239 |
| 5,553,858 | 9/1996 | McKoon et al. | 473/294 |
| 5,558,332 | 9/1996 | Cook | 473/341 |
| 5,584,769 | 12/1996 | Sundin | 473/325 |

*Primary Examiner*—George J. Marlo
*Attorney, Agent, or Firm*—Seed and Berry LLP

[57] ABSTRACT

A golf club of the type for putting and driving a golf ball. The golf club has a reflective surface which is positionable to direct toward a golfer's eye an alignment image including an image of the ball and the target into which the ball is directed so as to aid the golfer in positioning the head of the golf club relative to the ball. The reflective surface is removable from the head so as to be stowed when not in use. The golf club also includes a leveling device in the head of the club to indicate to the golfer when the head is aligned horizontally. The golf club further includes a first striking surface with a tilted striking surface portion for imparting spin to the golf ball, and a second striking surface opposite the first for directing the ball in an upward trajectory. The tilted striking surface may include a flat central portion and an adjacent flat end portion, both of which contact the golf ball. Third and fourth striking surfaces are positioned between the first and second striking surfaces at opposite ends of the head. To strike the ball with the third or fourth striking surfaces, the golfer positions himself behind the ball and astride a desired path between the ball and the target.

14 Claims, 4 Drawing Sheets

GOLF CLUB

TECHNICAL FIELD

The present invention is directed toward golfing equipment and more particularly, toward a golf club with a reflective surface.

BACKGROUND OF THE INVENTION

During the course of a typical golf game, a golfer is at times required to putt a golf ball a short distance in order to sink the ball in a hole. To putt the ball, the golfer typically stands facing the ball so that his shoulders are parallel to the path he intends the ball to take. The golfer then extends the golf club toward the ball so that a head of the golf club is aligned with the ball. The golfer swings the head of the club toward the ball, striking the ball and propelling it toward the hole.

A drawback of conventional golf clubs is that when the golfer aligns the head of the golf club with the ball, the golfer's eyes are not aligned with the path he intends the ball to take. This is so because the golfer typically stands to the side of the path and looks across the path rather than sighting along the path. As a result, the golfer may misalign the head of the club with the ball. The potential for misalignment is greatest on mid-range putts because the distance between the ball and the hole is of the same order as the distance between the ball and the golfer's eyes. A golfer using conventional clubs on mid-range putts must therefore be aware of the fact that his eyes are not accurately aligned with the path he intends the ball to take and must correct for this misalignment as he adjusts the position of the club head relative to the ball. The golfer must then maintain this correction as he moves the head of the club away from the ball and swings the head toward the ball. If the golfer does not accurately maintain the proper alignment between the ball and the head of the club, the ball will miss its target and the golfer's game will suffer.

A further drawback with conventional golf clubs is that the golfer has no way of accurately determining when the head of the golf club is horizontal. If the head of the club is not horizontal when the golfer strikes the ball, it may not strike the ball squarely causing the ball to diverge from its intended path and miss its target.

SUMMARY OF THE INVENTION

The present invention is directed toward a golf club that allows the golfer to more accurately align a head of the club with a golf ball. In one embodiment of the present invention, the golf club includes a shaft having first and second opposite ends with a handle toward the first end configured to be grasped by the golfer's hand. The club further includes a head connected to the shaft toward the second end. The head has at least a first striking surface configured to strike the golf ball and propel the ball along a desired path toward a target, such as a hole. A reflective surface is coupled to the club and positionable to direct an alignment image toward the golfer's eye. The alignment image includes images of the golf ball and the target. In operation, the golfer stands to one side of the desired path and adjusts the position of the head relative to the ball by viewing the alignment image reflected by the reflective surface. The reflective surface allows the golfer to more accurately position the head of the golf club relative to the ball and drive the ball more accurately toward its target while the golfer's body remains to one side of the desired path.

In one embodiment of the invention, the head of the golf club includes a first receiver opening for removably receiving a portion of the reflective surface. When in use, the reflective surface is partially positioned within the first receiver opening to direct the alignment image toward the golfer's eye. When not in use, the reflective surface is removed from the first receiver opening and stowed.

In a further embodiment of the invention, the golf club head includes a second striking surface positioned opposite the first striking surface and adapted to propel a golf ball in an airborne upward trajectory. The second striking surface is adapted to be used, for example, when the golfer wishes to drive the ball out of a sand trap or the like. The head further includes a third striking surface positioned intermediate the first and second striking surfaces and a fourth striking surface opposite the third. The golfer uses the third or fourth striking surfaces to strike the ball by positioning himself directly behind the golf ball on the desired path between the ball and its target so that he can accurately align the third or fourth striking surface with the ball and direct the ball along the desired path.

The present invention further provides a golf club head with a removable leveling device. The leveling device indicates to the golfer when the head of the club is substantially horizontal. In a preferred embodiment, the leveling device is a fluid-filled vessel containing a gas bubble which is centered in the vessel when the head is substantially horizontal.

The present invention also provides a method for directing a golf ball toward a target with a golf club. The method includes positioning a reflective surface to reflect an image of the ball and the target to the golfer's eye and moving a striking surface of the golf club to a position where it is substantially perpendicular to a travel path along which the golfer intends the ball to travel. The method further includes aligning the golf club relative to the ball using the image of the ball and the target and striking the ball with the striking surface. These and other aspects of this invention will become evident upon reference to the following detailed description and attached drawings.

DETAILED DESCRIPTION OF THE INVENTION

Figure 1:
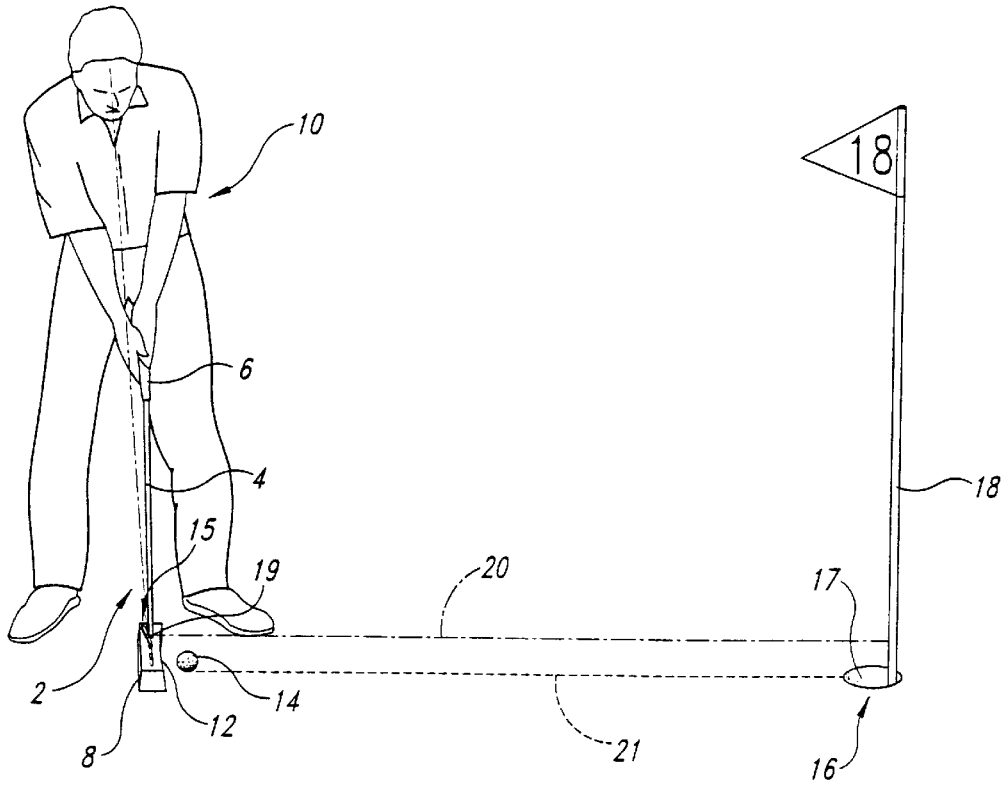
FIG. 1 is an isometric view of a golfer holding a golf club in accordance with the present invention and aligning a ball with a target using a reflective surface of the golf club.
Figure 2:
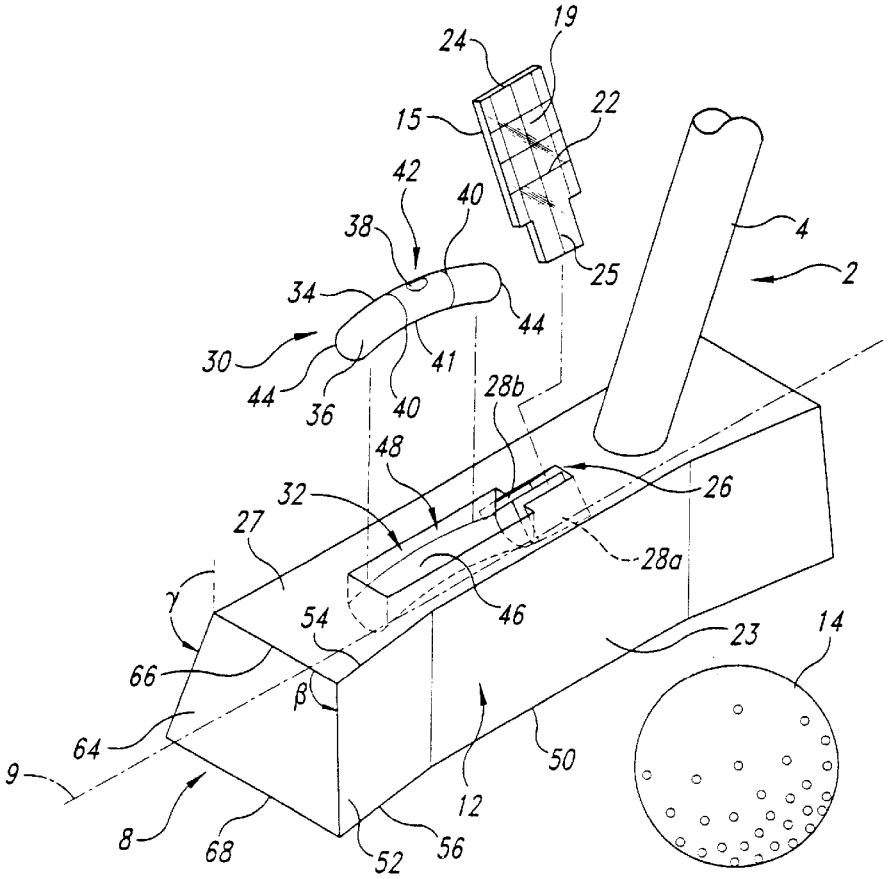
FIG. 2 is an enlarged, partially exploded top isometric view of a golf club head of the golf club of FIG. 1 having a reflective surface and a leveling device.

The present invention is directed toward a golf club having a reflective surface for aligning the club with a golf ball and propelling the golf ball toward a target, such as a hole. This feature of the golf club allows a golfer to more accurately propel the ball toward the target, reducing the number of strokes required by the golfer to successfully sink the ball in the hole and therefore improving the golfer's game. The golf club is primarily intended for use during practice, but is not necessarily limited to practice use. A representative golf club 2 in accordance with a preferred embodiment of the present invention is shown in the drawings for purposes of illustration. As is best seen in FIGS. 1 and 2, the golf club 2 includes a shaft 4 having a handle 6 at one end and an elongated club head 8 having a longitudinal axis 9 at an opposing end. A user or golfer 10 grasps the handle 6 and positions the head 8 so that a first striking surface 12 is proximate to a golf ball 14. The golfer 10 uses a reflective member 15 to align the head 8 with the ball 14 and a target 16 shown in FIG. 1 as a cup 17 and flag 18, and then strikes the ball with the first striking surface 12 to propel the ball toward the target.

As best shown in FIG. 2, in a preferred embodiment, the reflective member 15 has a reflective surface 19 sized and shaped to reflect to the golfer's eye an alignment image 20, which is shown schematically in FIG. 1 by a phantom line. The alignment image 20 includes an image of both the ball 14 and the target 16. In one embodiment the alignment image 20 also includes an image of the head 8. By viewing the alignment image 20, the golfer 10 can accurately align the head 8 with the ball 14 so as to propel the ball along a desired path 21 toward the target 16. The golfer 10 is able to accurately align the head 8 even though the golfer stands to one side of the path 21. This is so because the reflective surface 19 reflects to the golfer's eyes an alignment image 20 which is similar to what the golfer would see if the golfer were sighting directly along the path 21 from a position just behind the ball 14.

The reflective member 15 is preferably a conventional glass or plastic mirror or may be formed from a highly polished metal. In alternate embodiments, the reflective member 15 may be formed from other materials which are capable of reflecting a clear image of the ball 14 and target 16, and which are sufficiently resilient to withstand the shock loads generated when the first striking surface 12 strikes the ball. The reflective surface 19 is preferably sized and shaped so that the reflected alignment image 20 includes images of both the ball 14 and the target 16, as discussed above. In one embodiment, the reflective surface is sized to include an image of a portion of the head 8 as well, to aid the golfer 10 in aligning the head 8 with the ball 14.

To further aid the golfer 10 in aligning the head 8 with the ball 14, the reflective surface 19 preferably includes alignment indicators or markings 22 as shown in FIG. 2. In one embodiment, the alignment indicators 22 are arranged in a grid pattern. The grid pattern provides the golfer 10 with horizontal and vertical points of reference, allowing the golfer to more easily align the head 8 with the ball 14.

In a preferred embodiment, the reflective member 15 is mounted to the head 8 of the golf club 2 with the reflective member proximate to a central surface portion 23 of the first striking surface 12 with which the golfer 10 intends to strike the ball 14. In this way, the golfer 10 may easily align the reflection of the ball 14 appearing in the reflective surface 19 with the central surface portion 23. In a preferred embodiment, a top edge 24 of the reflective surface 19 is held parallel to the central surface portion 23, so that when the reflection of the ball 14 is aligned with the central surface portion 23, the ball itself is also aligned with the central surface portion. In other embodiments, the reflective surface is positioned to align the golf ball 14 with other portions of the golf club 2.

In the preferred embodiment, the reflective member 15 is removably attached to the head 8. The reflective member 15 includes a narrow tab 25 which projects away from the reflective surface 19. The tab 25 is configured to slide into and out of a first receiver opening 26 positioned in an upper surface 27 of the head 8. When the tab 25 is inserted into the first receiver opening 26, the reflective surface 19 projects upwardly away from the head 8 and is available for use to assist the golfer 10 in aligning the head with the ball 14 as described above.

When not in use, the reflective member 15 is removed from the head 8 by withdrawing the tab 25 from the first receiver opening 26. The reflective member 15 may then be stowed until it is again required. When stowed, the reflective member 15 is protected from potentially harmful contact with other objects, such as other golf clubs in a golf bag. When stowed, the reflective member 15 is also less likely to create extraneous reflections which unnecessarily distract the golfer when the golfer makes shots which do not require the use of the reflective member.

As shown in FIG. 2. the first receiver opening 26 preferably includes a narrow slot 28*a* of sufficient depth to snugly receive and hold the tab 25 of the reflective member 15. In alternate embodiments, the slot 28*a* has shapes to accommodate tabs 25 having shapes or orientations other than those shown in FIG. 2. The slot 28*a* retains the tab 25 of the reflective member 15 to hold the reflective member steady as the golfer aligns the head 8 and strikes the ball 14. In the preferred embodiment, the slot 28*a* is oriented at an acute angle relative to the upper surface 27 of the head 8, as shown in FIG. 2. When the reflective member 15 is mounted to the head 8 by inserting the tab 25 into the slot 28*a*, the reflective surface 19 projects above the upper surface 27 at a selected angle relative to the upper surface. The reflective surface 19 is thus positioned at or near an orientation which projects the desired alignment image 20 (see FIG. 1) to the golfer's eye.

In alternate embodiments, not shown, the head 8 includes a plurality of first slots 28*a*, each oriented at a different angle relative to the upper surface 27. In one such embodiment, each slot 28*a* is positioned to orient the reflective member 15 at a slightly different angle relative to the head 8 so as to project alignment images 20 at slightly different angles and thereby accommodate golfers of different heights or postures. In the preferred embodiment, the receiver opening 26 includes a second slot 28*b*, selectively positioned to orient the reflective member 15 for use with striking surfaces other than the first striking surface 12, as will be discussed in greater detail with reference to FIG. 3.

In an alternate embodiment, not shown, the reflective member is removably attached to the shaft 4 of the golf club 2. In this embodiment, the receiver opening 26 and slot 28*a* are positioned in the shaft 4 to receive the reflective member 15. When attached to the shaft 4, the reflective member 15 is positioned to convey to the golfer 10 the alignment image 20 to aid the golfer in aligning the head 8 with the ball 14, in the same manner as discussed above.

In the embodiment shown in FIG. 2, the golf club 2 includes a leveling device 30 to further aid the golfer 10 in aligning the head 8 of the golf club with the ball 14. The leveling device 30 indicates to the golfer 10 when the longitudinal axis 9 of the golf club is horizontal, increasing the likelihood that the golfer will strike the ball 14 squarely. The leveling device 30 includes an elongated cylindrical vial 34 filled with a fluid 36 and containing a gas bubble 38, similar to a carpenter's level. The gas bubble 38 is centered between markings 40 when the vial 34 is horizontal. The vial 34 has a vial center portion 42 which is bowed upward relative to opposing vial ends 44. A lower surface 41 of the elongated vial 34 is curved upward along the longitudinal axis of the vial. This preferred shape provides a stable region at the vial center portion 42 in which the gas bubble 38 tends to rest when the vial 34 is horizontal. The preferred shape of the vial 34, therefore, makes it easier to place the head 8 in a horizontal position.

In the preferred embodiment, the leveling device 30 is removably positioned in a second receiver aperture 32 located in the upper surface 27 of the head 8. The second receiver aperture 32 is elongated to accommodate the elongated vial 34, but other shapes can be used in other embodiments to accommodate other shapes of leveling devices. In a further aspect of the preferred embodiment, the second receiver aperture 32 has a bowed lower surface 46 which corresponds to the curved shape of the vial lower surface 41. The vial 34 fits snugly in the second receiver aperture 32 such that the vial lower surface 41 is adjacent the lower surface 46 of the receiver aperture. Latches or other retaining devices (not shown) may be used to engage the leveling device 30 to fuirther ensure that it remains in position in the second receiver aperture 32.

The second receiver aperture 32 has an upper portion 48 opposite the lower surface 46. In a preferred embodiment, the upper portion 48 is open to allow the golfer 10 to easily read the leveling device 30 from above. The open upper portion 48 also allows the golfer 10 to remove the leveling device from the golf club 2 and protect it from damage when not in use.

Although the leveling device 30 is shown in FIG. 2 as being aligned with the longitudinal axis 9 of the elongated head 8, the leveling device may be aligned with other axes in other embodiments. For example, in one alternate embodiment, the leveling device 30 may be aligned perpendicular to the longitudinal axis 9 of the elongated head 8. In this embodiment, the leveling device 30 indicates to the golfer 10 whether the first striking surface 12 is aligned perpendicular to the ball 14 or whether it is tipped upward or downward relative to the ball 14. Alignment of the first striking surface relative to the ball 14 is important for determining how much arc, if any, the golfer 10 wishes to impart to the ball 14.

In a further aspect of the embodiment shown in FIG. 2, a lower surface 50 of the head 8 is substantially flat and substantially parallel to the upper surface 27. The flat lower surface 50 is substantially horizontal when the leveling device 30 indicates that the head 8 is horizontal. The lower surface 50 accordingly allows the golfer 10 to more easily position the head 8 horizontally. The golfer 10 first positions the head 8 to be roughly horizontal by resting the lower surface 50 on the ground near the ball 14. The golfer 10 then adjusts the head position slightly, if necessary, until the leveling device 30 indicates that the head is horizontal.

Operation of a preferred embodiment of a golf club 2 in accordance with the invention is best understood with reference to FIGS. 1 and 2. The golfer 10 attaches the reflective member 15 to the head 8 by inserting the tab 25 into the slot 28*a* of the first receiver opening 26 so the reflective surface 19 extends out of the first receiver opening at a predetermined angle relative to the head 8. The golfer 10 also positions the leveling device 30 in the second receiver aperture 32, such that the vial lower surface 41 mates with the corresponding lower surface 46 of the second receiver aperture. The golfer 10 then positions the head 8 of the golf club 2 behind the ball 14 as shown in FIG. 1 so that the first striking surface 12 is approximately perpendicular to the desired path 21 between the ball and the target 16 (i.e., the cup 17 in FIG. 1).

The golfer 10 adjusts the position of the reflective member 15 and reflective surface 19 by moving the head 8 until the image appearing in the reflective surface 19 includes an image of the ball 14 and the target 16. For alignment purposes, the flag 18 may be used to make the target 16 more visible, but the flag is typically removed just before the golfer strikes the ball 14. At the same time, the golfer 10 adjusts the position of the golf club 2 until the gas bubble 38 of the leveling device 30 is centered between the markings 40, indicating that the head 8 is horizontal. The golfer then strikes the ball 14 toward the target 16 with the first striking surface 12 in a conventional manner.

One advantage of the invention is that the reflective surface 19 allows the golfer 10 to properly align the head 8 of the golf club 2 with the ball 14. The reflective surface 19 may be aligned to reflect to the golfer an image of the ball 14 and the target 16 which is independent of the golfer's position with respect to the desired path 21 along which the ball travels. In this way, the golfer may stand in a conventional manner to one side of the path 21 and view an image of the ball 14 and target 16 substantially similar to the image the golfer would view if positioned directly behind the ball and sighting directly along the path. The reflective surface 16 therefore reduces the likelihood that the golfer 10 will misalign the golf club 2 with the ball 14.

A further advantage of the invention is that the leveling device 30 ensures that the head 8 is horizontal as the golfer 10 aligns the head with the ball 14, further ensuring that the golfer will strike the ball accurately. By positioning the head 8 in the proper horizontal orientation, the golfer reduces the chances for tipping the head so as to inadvertently loft the ball in an upward trajectory, or drive the ball into the ground.

Yet a further advantage of the invention is that the reflective member 15 and the leveling device 30 may be removed from the golf club 2 when not in use. In this way, the reflective member 15 and leveling device 30 may be attached to the club 2 only when needed and removed and stowed when not in use. When stowed, the reflective member 15 and leveling device 30 may be protected from damage and the golfer may be protected from unnecessary distractions.

Figure 3:
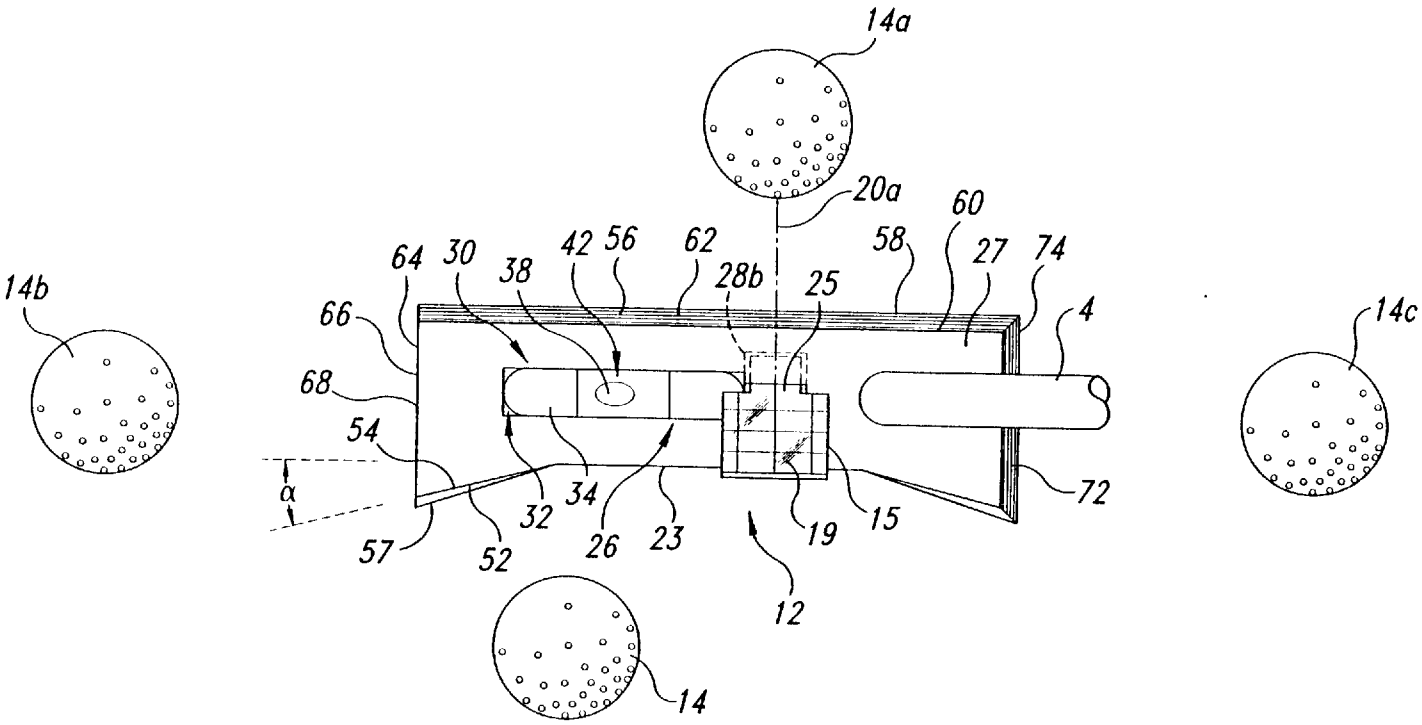
FIG. 3 is a top plan view of the golf club of FIG. 1 illustrating its multiple striking surfaces.

In the illustrated embodiment of the present invention, the first striking surface 12 of the golf club 2 includes a central surface portion 23 and an end surface portion 52, as best shown in FIGS. 2 and 3. The central surface portion 23 is preferably parallel to a plane which both contains the shaft 4 and is substantially perpendicular to the upper surface 27 and lower surface 50. The central surface portion 23 is therefore preferably perpendicular to the upper and lower surfaces 27 and 50. The end surface portion 52 is positioned at an angle 2 of approximately 15° to 20° and more preferably, approximately 15° relative to the central surface portion 23 when viewed from above. In addition, the end surface portion 52 is preferably canted relative to the upper surface 27 such that an upper edge 54 of the end surface portion is not aligned with a lower edge 57 when viewed from above. In a preferred embodiment, the end surface portion is canted outward at an angle B of approximately 105° relative to the upper surface 27. By positioning the end surface portion 52 at a selected angle relative to the central portion 23, and by canting the end surface portion relative to the upper surface 27, the end surface portion imparts a spin to the ball 14 when striking the ball.

In operation, the first striking surface 12 may be used to propel the ball 14 by striking the ball such that the end surface portion 52 and the central surface portion 23 both contact the ball when the first striking surface strikes the ball, i.e., on the same stroke. Because the end surface portion 52 and the central surface portion 23 are located in different planes, they strike different portions of the ball 14 and therefore impart a spin to the ball. When the ball spins, the distance the ball travels increases, as does the tendency for the ball to remain on the desired path 21 (see FIG. 1). Therefore, an advantage of the first striking surface 12 shown in FIG. 3 is that the surface tends to propel the ball 14 further and more accurately than a conventional striking surface, reducing the number of strokes required to sink the ball and improving the golfer's game.

In the preferred embodiment of the invention and as best shown in FIG. 3, the first striking surface 12 is one of multiple striking surfaces. A second striking surface 56 is positioned opposite the first striking surface 12 and may be used to strike a golf ball 14*a* in a conventional manner. The second striking surface 56 is canted outward so that a lower edge 58 is positioned outward from an upper edge 60. The second striking surface 56 thus forms a wedge surface suitable for propelling the golf ball 14*a* in an upward trajectory. The second striking surface 56 is preferably canted by approximately 160° to 180° relative to the shaft 4, as indicated by angle γ in FIG. 2, and more preferably canted by an angle of approximately 163° relative to the shaft. This embodiment of the second striking surface 56 is particularly suitable for propelling the golf ball 14*a* out of sand traps and the like.

The second striking surface 56 includes grooves 62 which are scribed, machined or otherwise formed in the second striking surface in a conventional manner. The grooves 62 impart a spin to the ball 14*a* to provide the golfer 10 with additional control over the trajectory of the ball.

Because the second striking surface 56 is opposite the first striking surface 12, the golfer reverses the direction of his swing when using the second striking surface. In the embodiment shown in FIG. 3, the golfer swings the club 2 in a right-handed fashion when using the first striking surface 12, and in a left-handed fashion when using the second striking surface 56. In an alternate embodiment, the positions of the first and second striking surfaces relative to the shaft 4 are reversed so that the golfer 10 uses a right-handed swing for the second striking surface 56 and a left-handed swing for the first striking surface 12.

In the embodiment of the golf club 2 shown in FIG. 3, the first receiver aperture 26 includes a second slot 28*b* as previously discussed. The second slot 28*b* allows the golfer to position the reflective member 15 so as to reflect an alignment image 20*a* which includes the ball 14*a* and a target (not shown) on the same side of the head 8 as the ball 14*a*. The golfer uses the reflective member 15 to align the second striking surface 56 with the golf ball 14*a* in substantially the same manner as discussed previously with respect to alignment between the first striking surface 12 and the golf ball 14.

In operation, the golfer 10 uses the second striking surface 56 in substantially the same manner as he would use the first striking surface 12. If desired, the golfer 10 places the reflective member 15 in the slot 28*b* so that the reflective surface 19 projects upwardly above the upper surface 27 of the head 8, as shown in FIG. 3. The golfer 10 may also place the leveling device 30 in the second receiver opening, if desired. The golfer 10 then grips the golf club 2 in a left-handed fashion and positions the head 8 so that the second striking surface 56 is proximate to the ball 14*a*. The golfer aligns the head 8 with the ball 14*a* using the reflective member 15 and leveling device 30, substantially as described previously in reference to FIGS. 1 and 2. Once the head 8 is properly aligned with the ball, the golfer strikes the ball in a conventional manner, propelling the ball toward the target with an upward trajectory.

An advantage of the golf club 2 is that a single golf club can be used to putt a golf ball by using the first striking surface 12, or direct the ball in an upward trajectory using the second striking surface 56. As a result, the golfer 10 need not switch clubs when the terrain demands different club faces. A further advantage of the golf club 2 is that the reflective surface 19 and leveling device 30 allow the golfer to more accurately align the head 8 of the club with the ball, reducing the number of strokes required by the golfer to sink the ball and therefore improves the golfer's game.

The golf club 2 also includes a third striking surface 64 positioned intermediate the first striking surface 12 and second striking surface 56, as best shown in FIGS. 2 and 3. The third striking surface 64 is preferably oriented perpendicular to the lower surface 50 and upper surface 27 so as to provide a surface suitable for putting a golf ball 14*b*. Thus, an upper edge 66 and a lower edge 68 appear as a single line when viewed from above as in FIG. 3.

Figure 4:
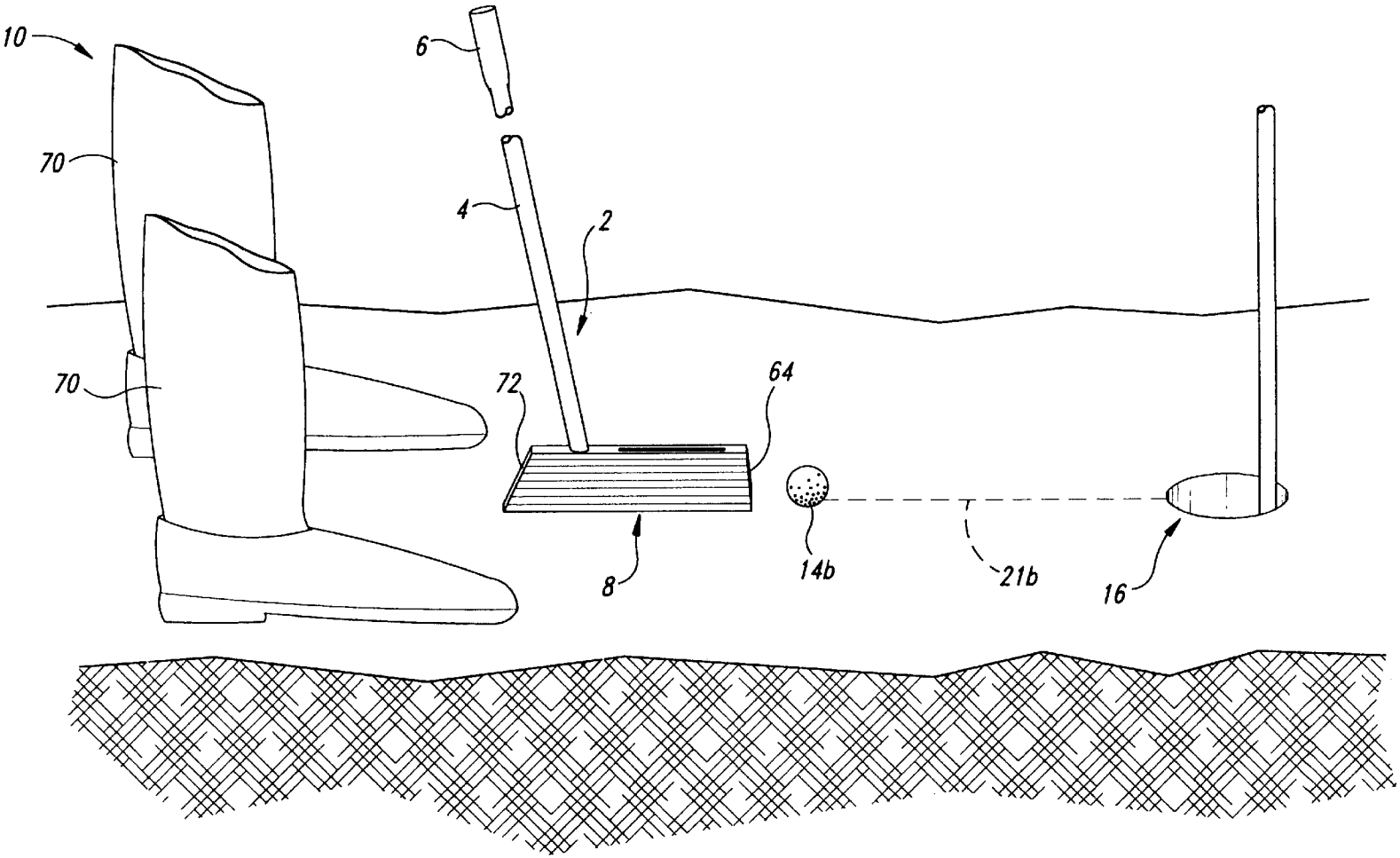
FIG. 4 is a side isometric view of a golfer positioned to direct a ball toward a target using a third striking surface of the golf club of FIG. 1.

Operation of the third striking surface 64 is best understood with reference to FIG. 4. The golfer 10 grasps the shaft 4 by the handle 6 and positions the head 8 of the golf club 2 such that the third striking surface 64 is adjacent the golf ball 14*b*. The golfer 10 then places each of his legs 70 on opposite sides of a desired path 21*b* between the golf ball 14*b* and the target 16 so that the third striking surface 64 is substantially perpendicular to the path. The golfer propels the ball 14*b* toward the target 16 by first moving the club 2 toward the legs 70 and then swinging the club toward the ball to strike the ball with the third striking surface 64 and putt the ball toward the target.

An advantage of the third striking surface 64 is that the golfer aligns his or her body and line of sight with the path 21*b* between the golf ball 14*b* and the hole 18*a*. In this way, the golfer is able to look directly along the path 21*b*, rather than looking at the path from a position alongside the path. Thus, the golfer can more accurately align the head 8 with the ball 14*b*. A further advantage is that the golfer is able to more easily maintain the alignment between the head 8 and the path 21*b* as he swings the club 2 toward the ball, increasing the likelihood that the ball will be propelled accurately toward the target 16. This is so because the golfer's arms are less likely to bend as the golfer swings the club 2 toward the ball, thereby reducing the tendency for the golfer to inadvertently misalign the head 8 during the course of the swing.

The golf club 2 further includes a fourth striking surface 72 positioned between the first and second striking surfaces 12 and 56 and opposite the third striking surface 64 as best seen in FIG. 3. The fourth striking surface 72 is at the end of the head toward the shaft 4 and is preferably canted outward at an angle of 73° to 75° relative to the lower surface 50 so as to propel a golf ball 14*c* in an upward trajectory. The fourth surface 72 is therefore particularly suitable for driving the golf ball 14*c* out of sand traps or other terrain where it is important to loft the ball above the ground. The fourth striking surface 72 further includes grooves 74 which impart a spin to the golf ball 14*c*, thereby improving the golfer's control over the trajectory of the ball.

Figure 5:
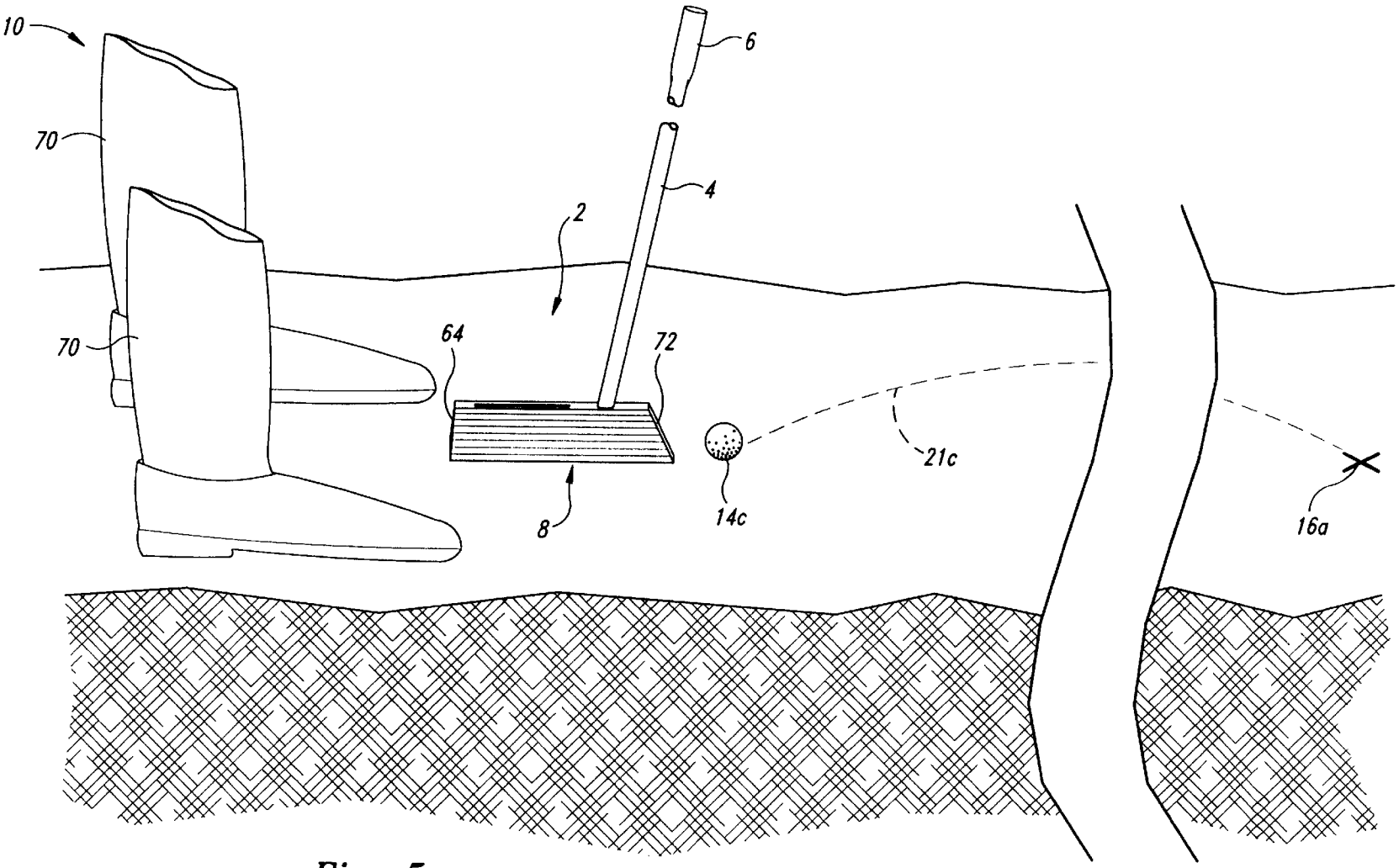
FIG. 5 is a side isometric view of a golfer positioned to direct a ball toward a target using a fourth striking surface of the golf club of FIG. 1.

Operation of the fourth striking surface 72 is best understood with reference to FIG. 5 and is substantially similar to operation of the third striking surface 64 as discussed above in reference to FIG. 4. The golfer grasps the shaft 4 by the handle 6 and positions the head 8 of the golf club such that the fourth striking surface 72 is adjacent the golf ball 14*c*. To do so, the golfer 10 extends his or her arms forward so as to grasp the handle 6 which is tilted away from the golfer. Accordingly, in a preferred embodiment of the invention, the shaft 4 projects at a steep angle upward from the head 8, so as to reduce the distance between the golfer 10 and the handle 6.The golfer then places each leg 70 on opposite sides of a desired path 21*c* between the golf ball 14*c* and a somewhat distant target 16a while aligning the fourth striking surface 72 to be perpendicular to the path 21*c*. The golfer 10 propels the ball 14*c* toward the target 16a by swinging the club 2 as discussed above in reference to FIG. 4.

As discussed above with reference to the third striking surface 64, an advantage of the fourth striking surface 72 is that the golfer aligns his or her body in line with the path 21*c* rather than alongside the path. In this way, the golfer can more accurately sight along the path and more accurately propel the ball 14*c* toward the target 16*a*. A further advantage of the fourth striking surface 72 is that the golfer is able to propel the ball in an upward trajectory while maintaining his or her body in alignment with the desired travel path 21*c*. In this way, the golfer can more accurately propel the ball 14*c* out of sand traps and other hazards which require that the ball be driven off the ground, reducing the number of strokes required to direct the ball away from these hazards and toward the target 16*a*.

Yet a further advantage of the fourth striking surface 72 is that it provides the golfer 10 with yet another surface with which to strike the golf ball, reducing the number of times that the golfer must switch clubs to make a particular shot. This saves the golfer time and reduces the number of clubs the golfer must carry.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A golf club, comprising:

a shaft having first and second opposite ends with a handle toward the first end configured to be grasped by a user's hand; and an elongated head connected to the shaft toward the second end, the head having a first elongated surface, a second elongated surface opposite the first, and a third surface intermediate the first and second surfaces, at least the first and third surfaces being configured to strike a ball and direct the ball toward a target, the first surface including a flat central portion and a flat end portion adjacent the central portion and disposed outwardly away from the shaft at an angle relative to the central portion greater than zero, both the central portion and the end portion being positioned to contact a golf ball when the head strikes the golf ball.

2. The golf club of claim 1 wherein the first surface is configured to propel the ball along the ground in the manner of putting.

3. The golf club of claim 1 wherein the first surface is oriented in a plane that is parallel to a plane containing the shaft.

4. The golf club of claim 1 wherein the second surface is adapted to propel the ball in an upward trajectory.

5. The golf club of claim 4 wherein the second surface is oriented at an angle in the range of approximately 160 degrees to approximately 180 degrees inclusive relative to the shaft.

6. The golf club of claim 4 wherein the second surface is oriented at an angle of approximately 163 degrees relative to the shaft.

7. The golf club of claim 1 wherein the third surface is adapted to propel the ball along the ground in the manner of putting.

8. The golf club of claim 1 wherein the shaft is attached to a portion of the head opposite the third portion.

9. The golf club of claim 1 further comprising a fourth surface intermediate the first and second surfaces and opposite the third surface.

10. The golf club of claim 9 wherein the fourth surface is adapted to strike the ball and direct the ball in an upward trajectory toward a target.

11. A golf club, comprising:

a shaft having first and second opposite ends with a handle toward the first end configured to be grasped by a user's hand; and an elongated head connected to the shaft toward the second end and having a striking surface configured to strike a ball and direct the ball toward a target, the striking surface having a flat central surface portion and a flat end surface portion adjacent the central surface portion and disposed relative to the central surface portion at an angle greater than zero, both the central surface portion and the end surface portion being positioned to contact a golf ball when the head strikes the golf ball.

12. The golf club of claim 11 wherein the end surface portion is disposed at an angle in the range of approximately 1 degree to approximately 20 degrees inclusive relative to the central surface portion.

13. The golf club of claim 11 wherein the end surface portion is disposed at an angle of approximately 15 degrees relative to the central surface portion.

14. A golf club, comprising:

a shaft having first and second opposite ends with a handle toward the first end configured to be grasped by a user's hand;

a head connected to the shaft toward the second end, the head having a first striking surface, a second striking surface opposite the first, and a third striking surface intermediate the first and second striking surfaces, and a fourth striking surface intermediate the first and second surfaces and opposite the third, each striking surface being configured to strike a ball and direct the ball toward a target, the first striking surface having a flat central surface portion and a flat end surface portion disposed relative to the central surface portion at an angle greater than zero, both the central surface portion and the end surface portion being positioned to contact the ball when the head strikes the ball; and a reflective surface having a tab removably received in an aperture of the head and positionable to direct toward the user's eye an alignment image which includes images of the ball and the target to aid the user in positioning the head relative to the ball for striking the ball with at least one of the first, second, third and fourth striking surfaces.

* * * * *